US005655806A

United States Patent [19]

Halladay et al.

[11] Patent Number: 5,655,806

[45] Date of Patent: Aug. 12, 1997

[54] TONGS WITH TAPERED JAWS

[76] Inventors: James J. Halladay, 46 Clauss St.; Gordon W. Halladay, 6 Herman St., both of Carteret, N.J. 07008

[21] Appl. No.: 551,717

[22] Filed: Nov. 1, 1995

[51] Int. Cl.[6] ..... B25B 7/02; B67B 7/02

[52] U.S. Cl. ..... 294/118; 294/28; 81/3.44; 81/420

[58] Field of Search ..... 294/3, 8.5, 16, 294/27.1, 28, 29, 31.1, 90, 99.2, 118, 902; 81/3.07, 3.4, 3.41, 3.42, 3.44, 418, 420, 424.5, 426, 426.5

[56] References Cited

U.S. PATENT DOCUMENTS

| | | | |
|---|---|---|---|
| 1,574,349 | 2/1926 | Johanson | 294/28 |
| 1,644,905 | 10/1927 | Whiteside | 294/31.1 |
| 2,360,770 | 10/1944 | Goodwin | 294/28 |
| 2,712,469 | 7/1955 | Burnor et al. | 294/16 |
| 3,817,126 | 6/1974 | Koebbeman | 81/3.44 |
| 4,595,221 | 6/1986 | De Geus et al. | 294/16 |
| 4,606,245 | 8/1986 | Veverka et al. | 81/3.4 |
| 4,848,191 | 7/1989 | Forrest | 81/3.44 |

*Primary Examiner*—Dean Kramer
*Attorney, Agent, or Firm*—Ezra Sutton

[57] ABSTRACT

A gripping tool of the pliers type for removing an inking plug from an ink container including a pair of pivotally connected handle members being connected by a pivot pin; and a pair of opposed semi-circular shaped jaws rigidly attached to the pair of handle members, respectively; such that each of the jaws forms an arc of between 90° and 180°. Each of the jaws has an L-shaped configuration in cross section and including a first wall member for engaging a first surface of the inking plug and a second wall member perpendicular to the first wall member, wherein the second wall member engages a second surface of the inking plug and includes a chamfered edge for engaging the space between the inking plug and the ink container for wedging them apart to allow the first and second wall member of each of the jaws to move towards each other so that the respective first and second wall members of each of the jaws may fully engage the first and second surfaces of the inking plug to pull it away from the ink container.

7 Claims, 2 Drawing Sheets

TONGS WITH TAPERED JAWS

FIELD OF THE INVENTION

This invention relates to a new type of gripping tongs, and more particularly, this invention relates to a gripping tongs with tapered jaws for dislodging an inking plug from an ink container.

BACKGROUND OF THE INVENTION

Gripping tongs have taken many forms in relation to structure, shapes, functionality and types of construction materials used generally. Gripping tongs have jaws that are used for many different types of activities that include lifting of pipes, gripping of light bulb bases, crimping of cartridge shells, clamping of exhaust pipes, gripping of mason jar tops, and the like. At present gripping tongs with serrated jaws or ridged jaws are not capable of removing an inking plug from an ink container without destroying the integrity of the inking plug. The serrated or ridged jaws of present gripping tongs damage, mar and/or crush the inking plugs cylindrical walls which makes the re-use of the inking plug impossible, as the inking plug cannot be reattached into the neck opening of the ink container.

There remains a need for a specialized gripping tongs having special tapered jaws for prying-off and lifting-up of an inking plug from the neck section of an ink container. This specialized tapered jaw would be semi-circular in shape having an L-shaped chamfered edge for entering the space between the inking plug and the bottle-neck, and wedging them apart.

DESCRIPTION OF THE PRIOR ART

Gripping tongs with jaws having various designs, styles, appearances, and materials of construction have been disclosed in the prior art. For example, U.S. Pat. Nos. 1,468,344; 1,605,811; and 1,906,454 all disclose a tapered jaw with and without toothed edges for lifting of a pipe or a mason jar out of boiling water.

U.S. Pat. Nos. 1,605,811; 1,906,454; 1,910,750; and 2,779,224 all disclose circular jaws with and without serrated or toothed edges for gripping and removing of a jar lid, light bulb socket-end, and the like. None of these aforementioned prior art patents show an L-shaped tapered jaw having a chamfered edge for entering the space between the inking plug and the bottle-neck and wedging them apart.

Accordingly, it is an object of the present invention to provide gripping tongs having tapered jaws for prying and lifting-off of an inking plug from the bottle-neck of an ink container without damaging, marring, or crushing the inking plug while removing it.

Another object of the present invention is to provide gripping tongs with tapered jaws that are easy to use for prying-off of an inking plug.

Another object of the present invention is to provide gripping tongs with tapered jaws having chamfered edges for entering the space between the inking plug and the bottle-neck of the ink container and wedging them apart.

An even further object of the present invention is to provide gripping tongs with tapered jaws that can be mass produced in an automated and economical manner and is readily affordable by the user.

SUMMARY OF THE INVENTION

In accordance with the present invention, there is provided an improved and new gripping tool or tongs of the pliers type for removing an inking plug from an ink container. The gripping tool or tongs includes a pair of pivotally connected handle members being connected by a pivot pin; and a pair of opposed semi-circular shaped jaws rigidly attached to the pair of handle members, respectively; such that each of the jaws forms an arc of between 90° and 180°. Each of the jaws has an L-shaped configuration in cross section and including a first wall member for engaging a first surface of the inking plug and a second wall member perpendicular to the first wall member, wherein the second wall member engages a second surface of the inking plus and includes a chamfered edge for engaging the space between the inking plug and the ink container for wedging them apart to allow the first and second wall member of each of the jaws to move towards each other so that the respective first and second wall members of each of the jaws may fully engage the first and second surfaces of the inking plug to pull it away from the ink container.

BRIEF DESCRIPTION OF THE DRAWINGS

Further objects, features, and advantages of the present invention will become apparent upon consideration of the detailed description of the presently-preferred embodiments, when taken in conjunction with the accompanying drawings wherein.

DETAILED DESCRIPTION OF THE PREFERRED EMBODIMENT

Figure 1:
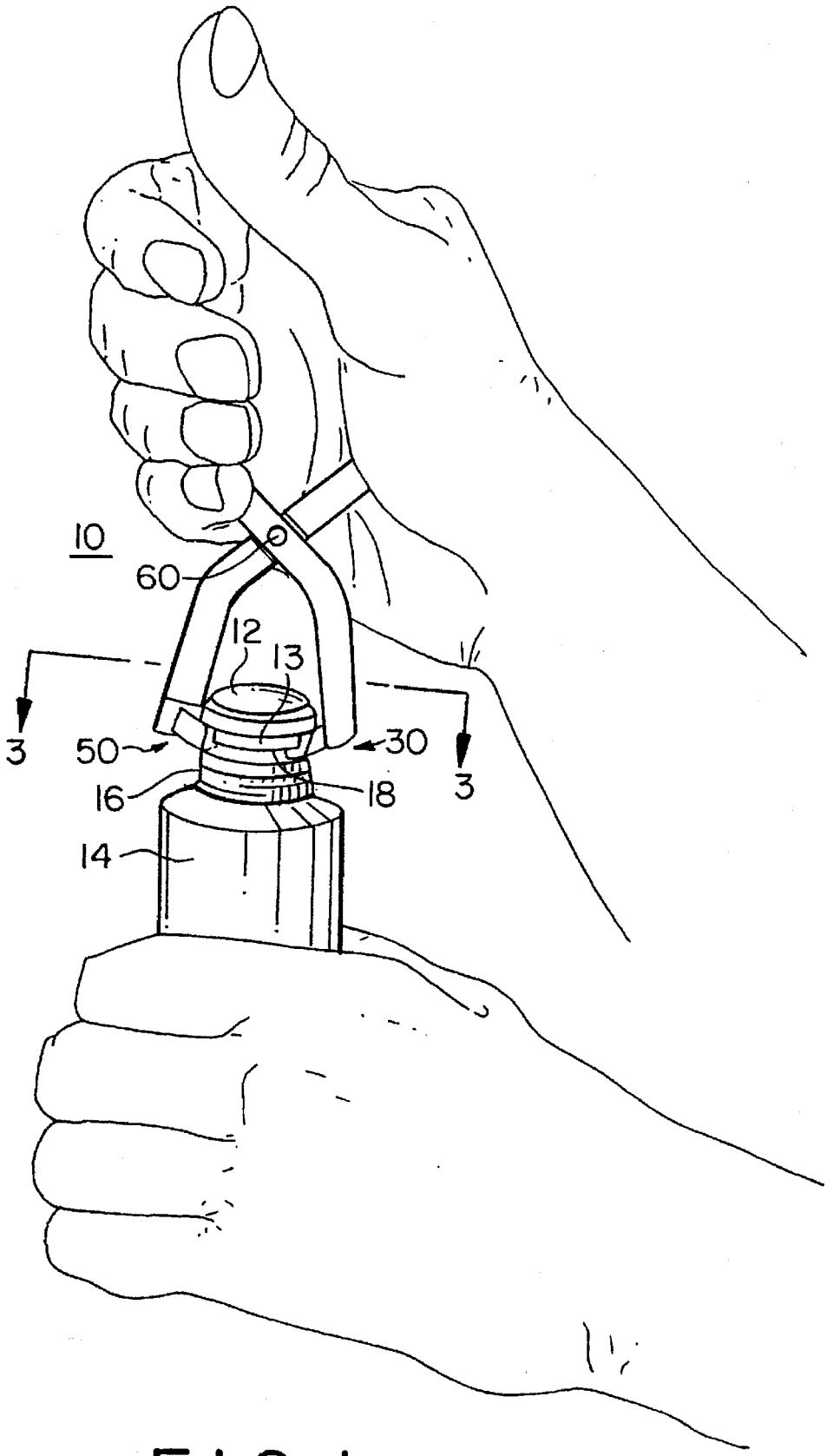
FIG. 1 is a perspective view of the gripping tongs with tapered jaws of the present invention showing its use of prying-off the inking plug from the bottle-neck of an ink bottle.
Figure 2:
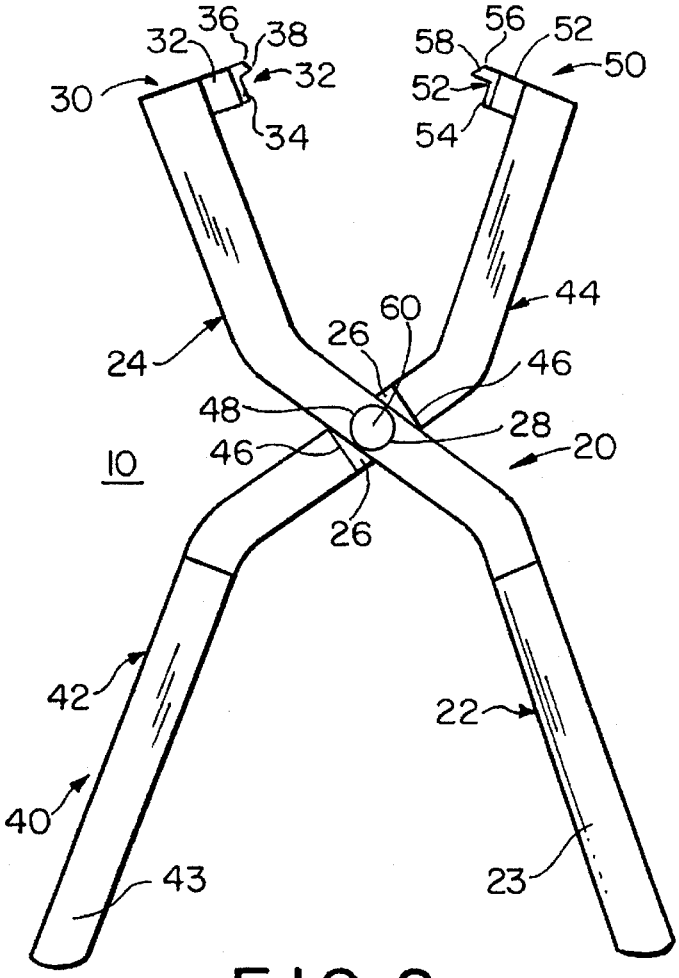
FIG. 2 is a front view of the gripping tongs showing the semi-circular tapered jaw having an L-shaped chamfered edge.
Figure 4:
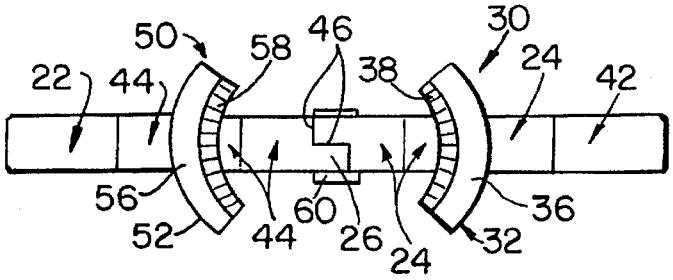
FIG. 4 is a top plan view of the gripping tongs showing the semi-circular tapered jaws having L-shaped jaws with chamfered edges.
Figure 3:
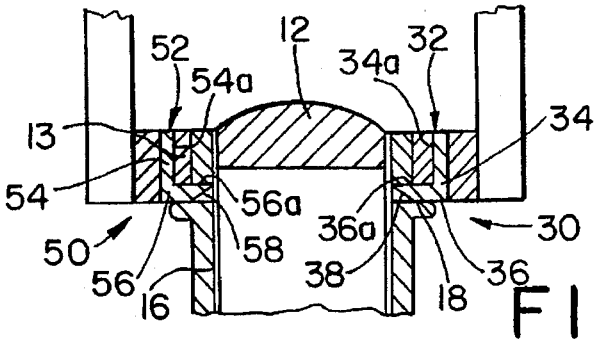
FIG. 3 is an enlarged sectional view taken along lines A—A of FIG. 1 showing the tapered jaw of the gripping tongs engaged with the inking plug.

The preferred embodiment of the present invention provides for gripping tongs 10 with tapered jaws 30 and 50, used for the prying-off of an inking plug 12 from an ink container 14, as represented in FIGS. 1 through 4 of the drawings. FIGS. 1 and 2 show the tongs 10 in operation for prying-off of an inking plug 12. FIGS. 3 and 4 show the tongs 10 and the component parts thereof. The tongs 10 include a first section 20, as shown in FIGS. 3 and 4, having a handle member 22 being integrally formed with an arcuate portion 24. The first section 20 further includes a centrally located slot 26 having a pivot pin opening 28. The arcuate portion 24 includes a rigidly attached jaw section 30 having a semi-circular and L-shaped tapered gripping member 32. Gripping member 32 includes a first engaging vertical wall member 34 having an inner surface **34*a* for engaging the inking plug 12; a second engaging horizontal wall member 36 having an inner surface 36*a* for engaging the inking plug 12; and the second engaging horizontal wall member 36 having a chamfered edge 38 for prying-up of the inking plug 12**.

The second section 40 of tongs 10 includes a handle member 42 being integrally formed with an arcuate portion 44. The second section 40 further includes a centrally located slot 46 having a pivot pin opening 48. The arcuate portion 44 includes a rigidly attached jaw section 50 having a semi-circular and L-shaped tapered gripping member 52. Gripping member 52 includes a first engaging vertical wall member 54 having an inner surface 54*a* for engaging the inking plug 12; a second engaging horizontal wall member 56 having an inner surface 56*a* for engaging the inking plug 12; and the second engaging horizontal wall member 56 having a chamfered edge 58 for prying-up of the inking plug 12. The chamfered edges 38 and 58 have a 45° slant inwardly relative to the inner surfaces 36*a* and 56*a* of wall members 36 and 56.

The handle members 22 and 42 of first and second sections 20 and 40 are pivotally connected by means of a pivot pin 60 which passes through hole openings 28 and 48 within slot sections 26 and 46. This enables the handle members 22 and 42 to rotate the jaw sections 30 and 50 inwardly about pivot pin 60 to have the gripping members 32 and 52 connect with the neck section 16, such that the chamfered edges 38 and 58 pry-off the inking plug 12. The gripping members 32 and 52 are then used to grip the inking plug 12 to remove it upwardly from the neck of ink container 14.

The gripping tongs 10 with tapered jaws 30 and 50 are preferably made from cold rolled steel. The handle members 22 and 42 and arcuate portion members 24 and 44 are made from ¼ square cold rolled square steel. The tapered jaws 30 and 50 are made from 1 inch diameter cold finished round steel. Each of the jaws 30 and 50 forms an arc of between 90° and 180°, but preferably, form an arc of between 120° to 150°, as shown in FIG. 4 of the drawings. Pivot pin 60 is a 6/32 of an inch round head steel pin. Gripping tongs 10 can also be made from other construction materials, such as stainless steel, iron, aluminum or a rigid molded plastic. Handle members 22 and 42 may be covered in shrink-wrapped plastic, non-slip handle grips 23 and 43 for ease of firmly gripping the tongs 10. The gripping tool 10 has an overall length dimension of 4⅜ inches and a width dimension of 1½ inches when in a closed position. First engaging vertical wall members 34 and 54 each have a wall height of three-sixteenths of an inch (3/16"), and second horizontal wall members 36 and 56 each have a wall width of five-thirty seconds of an inch (5/32").

OPERATION OF THE PRESENT INVENTION

A typical application for using the gripping tongs 10 would be the refilling of ink containers 14 in connection with a bingo party or event. In use, the tapered jaws 30 and 50 are placed around the inking plug 12, such that, the user gently squeezes together handle members 22 and 42 which rotates the jaw sections 30 and 50 inwardly about pivot pin 60, as shown in FIGS. 1 and 3. This forces the engaging wall inner surfaces 34*a* and 36*a* of gripping member 32 and the engaging wall inner surfaces 54*a* and 56*a* of gripping member 52 to begin gripping the cylindrical wall 13 of inking plug 12, such that the chamfered edges 38 and 58 enter the space 18 between the inking plug 12 and the bottle-neck 16 of ink container 14, and wedges them apart. The user then gently twists and pries upwardly the inking plug 12, as the chamfered edges 38 and 58 and gripping wall members 32 and 52 further engage the cylindrical wall 13 of inking plug 12, as shown in FIG. 2. The user then continues to manipulate the gripping tongs 10 to remove the inking plug 12 off of the ink container 14. Use of the gripping tongs 10 with tapered jaws 30 and 50 does not damage the inking plug 12 as it is removed from the ink container 14, even after many repeated removals of the inking plug 12 from ink container 14.

ADVANTAGES OF THE PRESENT INVENTION

Accordingly, an advantage of the present invention is that it provides for a gripping tongs having tapered jaws for prying and lifting-off of an inking plug from the neck of an ink container without damaging, marring, or crushing the inking plug while removing it.

Another advantage of the present invention is that it provides for a gripping tongs with tapered jaws that are easy to use for prying-off of an inking plug.

Another advantage of the present invention is that it provides for a gripping tongs with tapered jaws having chamfered edges for entering the space between the inking plug and the bottle-neck of the ink container and wedging them apart.

An even further advantage of the present invention is that it provides for a gripping tongs with tapered jaws that can be mass produced in an automated and economical manner and is readily affordable by the user.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A gripping tool for removing an inking plug from an ink container, comprising:

a) a pair of pivotally connected handle members connected by a pivot pin; each of said handle members having an upper handle section; said upper handle sections lying in a first plane;

b) a pair of opposed semi-circular shaped jaws; each of said jaws being rigidly attached to one of said upper handle sections at a 90° angle to said first plane;

c) each of said jaws forming an arc of between 90° and 180°;

d) each of said jaws having an L-shaped configuration in cross section and including a first vertical member for engaging a first surface of the inking plug and a second horizontal member perpendicular to said first member, wherein said second member engages a second surface of the inking plug and includes a chamfered edge on the end thereof; and e) said chamfered edge facing away from said pivot point; said chamfered edge for engaging the space between the inking plug and the ink container for wedging them apart to allow said first and second member of each of said jaws to move towards each other so that said respective first and second members of each of said jaws may fully engage the first and second surfaces of the inking plug to pull it away from the ink container.

2. A gripping tool in accordance with claim 1, wherein each of said jaws form an arc from about 120° to about 150°.

3. A gripping tool in accordance with claim 1, wherein said handle members, said pivot pin, and said jaws are made from steel, stainless steel, aluminum, iron, or rigid molded plastic.

4. A gripping tool in accordance with claim 1, wherein said handle members are covered with non-slip plastic handle grips for a firmer grip.

5. A gripping tool in accordance with claim 1, wherein each of said chamfered edges have approximately a 45° slant for wedging.

6. A gripping tool in accordance with claim 1, wherein said gripping tool has an overall length measurement of approximately 4⅜ inches and a width measurement of approximately 1½ inches.

7. A gripping tool in accordance with claim 1, wherein each of said semi-circular shaped jaws has a diameter of approximately 1.0 inches and wherein said first member has a height of three-sixteenths of an inch (3/16") and wherein said second member has a width of five-thirty seconds of an inch (5/32").

* * * * *